United States Patent [19]

Inman

[11] Patent Number: 4,525,999

[45] Date of Patent: Jul. 2, 1985

[54] ACTUATOR FOR DEPLOYING FLEXIBLE BODIES

[75] Inventor: Frank S. Inman, Brigham City, Utah

[73] Assignee: Thiokol Corporation, Chicago, Ill.

[21] Appl. No.: 452,547

[22] Filed: Dec. 23, 1982

[51] Int. Cl.[3] ..... F01B 29/08; F15B 11/06; F15B 15/22; F15B 15/26

[52] U.S. Cl. ..... 60/407; 60/635; 91/169; 91/401; 92/26; 92/52; 239/265.19; 239/265.33

[58] Field of Search ..... 60/271, 407, 635; 92/23, 26, 30, 52, 53; 91/401, 169; 239/265.33, 265.19

[56] References Cited

U.S. PATENT DOCUMENTS

| | | | |
|---|---|---|---|
| 328,730 | 10/1885 | Thoens | 91/401 |
| 1,876,024 | 9/1932 | Rosenberry | 91/401 |
| 1,928,533 | 9/1933 | Goss | 92/53 |
| 2,497,084 | 2/1950 | Irby | 60/635 |
| 2,614,887 | 10/1952 | Shields | 239/268 |
| 2,839,032 | 6/1958 | Reynolds | 91/401 |
| 3,081,705 | 3/1963 | Warnken | 239/265.11 |
| 3,199,288 | 8/1965 | Nahas | 92/23 X |
| 3,346,186 | 10/1967 | Fulton et al. | 239/265.15 X |
| 3,563,467 | 2/1971 | Marsh | 239/265.17 |
| 3,648,461 | 3/1972 | Bailey et al. | 60/271 |
| 4,228,725 | 10/1980 | Jai | 92/248 X |

FOREIGN PATENT DOCUMENTS

| | | | |
|---|---|---|---|
| 865847 | 2/1953 | Fed. Rep. of Germany | 92/26 |
| 281335 | 4/1928 | United Kingdom | 92/53 |

*Primary Examiner*—Irwin C. Cohen
*Attorney, Agent, or Firm*—Gerald K. White

[57] ABSTRACT

A pneumatic actuator for deploying flexible bodies and the like is disclosed. The actuator is a plurality of telescoping tubes made of high temperature resistant graphite material which are extended by the pressure of gases produced internally by a gas generator contained within the innermost tube. The extended tubes are locked in position automatically and venting of the gases from the tube interior is provided for simultaneously with full and locked extension of the tubes.

1 Claim, 4 Drawing Figures

ACTUATOR FOR DEPLOYING FLEXIBLE BODIES

BACKGROUND OF THE INVENTION

1. Field of the Invention

This invention relates to actuators and actuation systems in general which are extendable for use in the deployment of flexible bodies and similar objects. More particularly, this invention relates to extendible actuator devices constructed of light weight materials having high temperature resistant properties suitable for use in high temperature environments for deploying flexible nozzle extensions of rocket motors and, in addition, are telescopic and self-locking when extended.

In a preferred use for deploying rocket motor nozzle extensions, the actuator has a hollow interior and is extended pneumatically by gas pressure to deploy the extension to which it is attached. Pressure gas is supplied by a gas generator contained interiorly of the device. In its fully extended position, the interior is simultaneously vented of the actuating gas automatically eliminating its added weight.

Briefly, this invention utilizes a plurality of hollow, movable segments, elements or members of the form arranged telescopically with a fixed base member in which a gas generator is housed. Each movable member has a resilient end portion which facilitates telescoping of the members and further features a device in the form of a radially extending projection which engages with another device in the form of a recess in an opposite end of the member to lock the member in its fully extended position and thereby deploy an extendible body such as a folded, flexible nozzle extension on a rocket motor.

2. Description of the Prior Art

Actuators of the class to which the present invention belongs, including telescoping ones, are well known. For example, telescoping pneumatic actuators made of metal have long been fabricated even for rocket motors and nozzle extensions. These devices, however, as typified by the one disclosed in U.S. Pat. No. 3,346,186 tend to be overly heavy and incapable of sustained operation in the high temperature environment (exceeding 5000° F.) of a rocket motor, particularly radiation cooled motors and nozzles. In addition, in this device, self-actuation and self-locking are unknown and venting of actuation gas is neither provided for nor taught and, although pressurization by gas is shown, it is supplied from an outside source such as a pressure fluid container or the like carried on board. Venting of the interior, as mentioned herein is not considered, hence the system of this patent of necessity must be considered as too cumbersome and complex for extensive use in rocket motor nozzle extension deployment systems.

In the non-related art of lawn sprinklers, U.S. Pat. No. 2,614,887 exists which discloses telescoping water conduit sections and which, intended to be extended manually, is provided with internal seal means to prevent water leakage between sections. This device is not, nor is it intended to be used as an actuator, hence it cannot be used to extend deployable bodies as in the present invention, nor is locking of the various sections provided for when extended.

In another patent illustrative of rocket motor actuation devices, U.S. Pat. No. 3,563,467, slidable nozzle covers movable longitudinally of the nozzle by hydraulic actuation means are disclosed. The actuators shown, however, are not telescopic nor is there any suggestion in the disclosure of this patent that the materials of which the devices are made should be selected on the basis of light weight or possession of high temperature resistant properties.

As an illustration and example of high temperature resistant materials, U.S. Pat. No. 3,081,705 is of interest as disclosing a method of making laminated articles by winding strips of resin impregnated material on a mandrel. To the extent that the disclosure of this patent aids in a better understanding of the present invention, its teachings may be found useful and helpful. However, in no way can this patent be construed to disclose or obviate the teachings of the present invention of an actuator for the purpose described.

The present invention, owing to its light weight construction, preferably graphite, its capability for self-locking in extended position, its capability for timely shedding of added weight, such as that of the gases generated to extend the device which are automatically vented overboard and its possession of high temperature resistant properties with strength retention, provides a genuine advance in the art of actuation devices in general and for devices of this kind which are called upon to operate in the high temperature environment of a rocket motor.

SUMMARY OF THE INVENTION

Among the objects of the present invention is to provide a light weight, high strength actuation system for deploying flexible bodies normally stored in a folded or collapsed condition.

Another object is to provide an actuator or system thereof of the character described which has high temperature resistant properties and is operable in a high temperature environment with little or no loss of strength.

Still another object of the invention is to provide an actuator and/or a system of actuators of the character described which is telescopic and adaptable for use in deploying, by extending, nozzle extensions of radiation cooled rocket motors and the like which operate in a high temperature environment without loss of strength.

An additional object of this invention is to provide an actuator of the character referred to which is substantially self-actuating, by pressurized gas, self-locking when extended from a telescoped position and automatically, in timely manner, vents the pressurizing gas when fully actuated and extended to deploy a flexible body.

In accomplishing these and the other objects, there is provided an actuator made of light weight, strong, high temperature resistant materials, a particularly preferred one being graphite. The device is comprised of a plurality of tubular members, segments or tube elements arranged telescopically, each member having a resilient end portion and, in the preferred embodiment formed by wrapping or winding a tape or strip of graphite fibers on a suitable mandrel in a predetermined, preferably helical pattern and impregnating the resulting product with a high temperature thermosetting resin. This cured product is then subjected to a high temperature of 3,000° to 5,500° F. to graphitize the resin or, alternatively the wrapping may be placed in a high temperature oven through which a carbonaceous gas is circulated. Pyrolitic graphite from dissociation of the gas is deposited in the fibers of the wrapping reducing its porosity. The members are then machined to proper geometry and assembled into a base tube, element or member similarly prepared and in which a gas generator is installed. The resilient end portions are prepared by axial slotting to facilitate telescoping upon assembly.

BRIEF DESCRIPTION OF THE DRAWINGS

For a better, fuller understanding of the invention, reference should be had to the following drawings illustrating the preferred embodiment and the following detailed description in which the best mode presently contemplated for carrying out the invention is set forth and wherein.

DESCRIPTION OF THE PREFERRED EMBODIMENT

Figure 1:
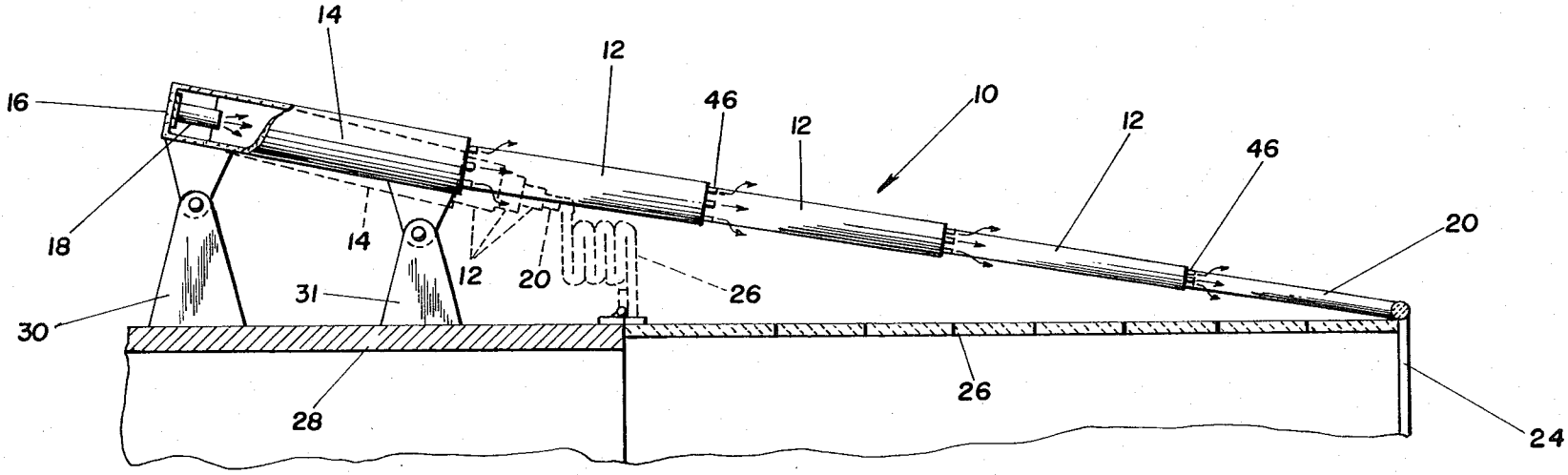
FIG. 1 is an elevational view of the actuator of the invention, partially sectioned, showing the same in a fully extended position when actuated to deploy a flexible body nozzle extension of a rocket motor on which the same is mounted, the telescoped position of the actuator and the normally collapsed storage condition of the flexible body shown in dash lines.

The present invention, best seen in FIG. 1, is an extendible, self-locking, high temperature resistant actuator 10, made preferably of graphite material capable of operating in relatively very high temperature environments with little or no loss of strength. Actuator 10 comprises a plurality of generally tubular, serially connected, telescopically arranged intermediate elements, members or tube segments 12, assembled together with an inner, base member 14. Base member 14 has a bottom end which is closed by a sealing cap or cover 16 upon which a gas generator 18 is mounted. An extreme outer end member or tube 20 has a top or outer closed end 22 which is coupled to a deployment ring 24, indicated diagrammatically in FIG. 1, to which a flexible or folded nozzle extension 26 is attached. Nozzle extension 26 is hingably connected at the exit or downstream end of an expansion or exit cone 28 of a rocket motor (not shown) and is adapted to be extended from a folded or collapsed condition in which it is normally stowed or stored, (dash lines in FIG. 1) to the operating or deployed position shown in FIG. 1. Actuator 10 operates by extension of movable telescopically arranged members 12 from base member 14 to deploy nozzle extension 26 and is mounted on the outside of expansion cone 28 on brackets or braces 30 and 31 supporting base member 14 in fixed relation.

Figure 2:
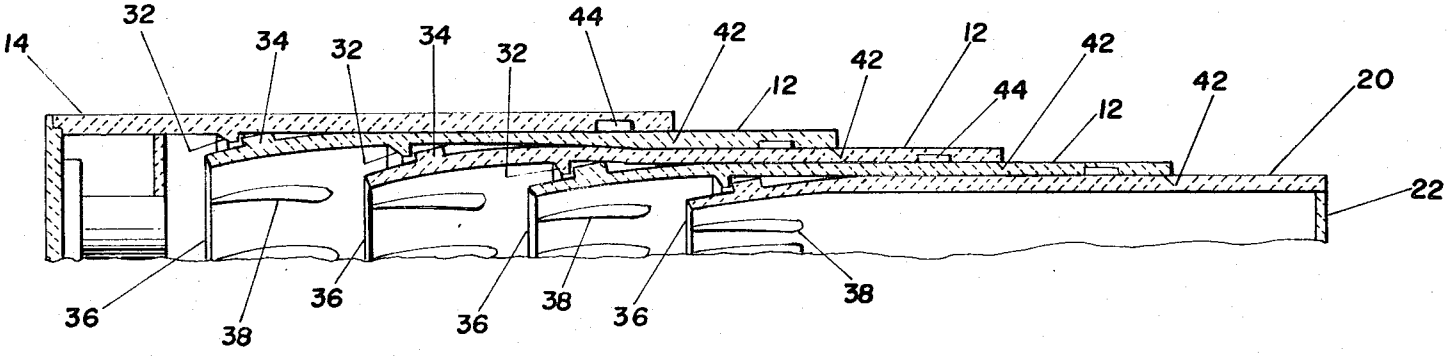
FIG. 2 is a partial longitudinal elevational section of the actuator shown in the telescoped position.
Figure 3:
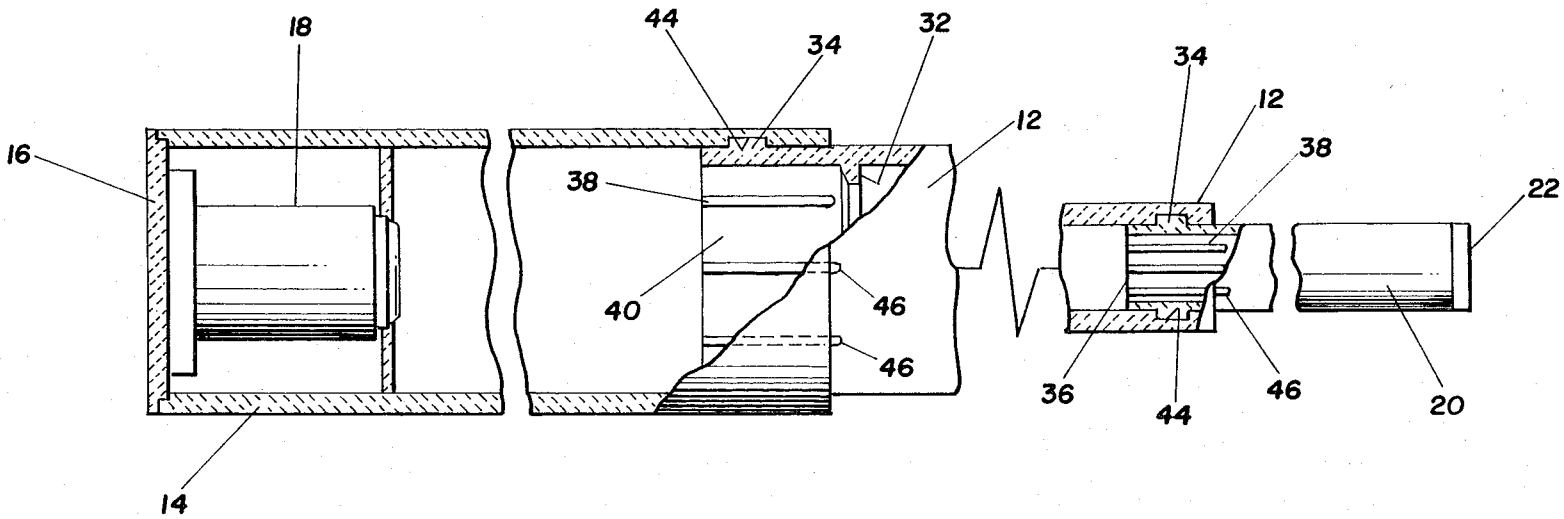
FIG. 3 is an elevation, partially sectioned illustrating the fixed inner or base member and the outer end member of the actuator as these parts appear when the actuator is extended to the locked position; and, FIG. 4 is a perspective, partially sectioned, view of a preferred resilient end portion of a member and an outer end portion of an adjacent member.
Figure 4:
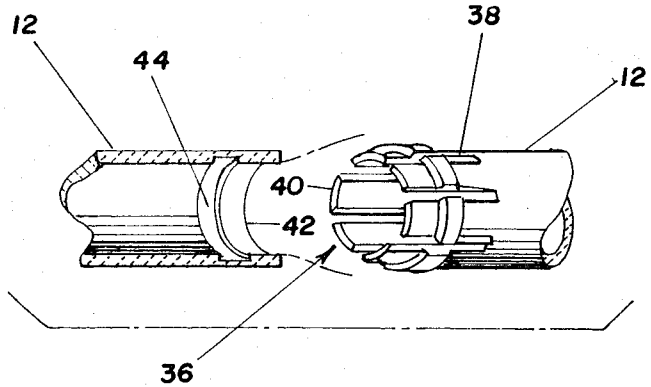

In FIG. 2, with reference to FIG. 4, actuator 10 is shown in its unextended or telescoped position and unactuated in which members or tubes 12 are telescoped together in fixed base member or tube 14 including outer tube 20. In this position, each tube 12 and outer tube 20 is bottomed in an adjacent tube 12 against a radial abutment or stop 32 formed in the inner surface thereof and in base member 14. A radially extending annulus or projection 34, best seen in FIG. 4, is formed on each of the resilient end portions 36 of tubes 12 and 20, each end portion 36 being resilient by virtue of the axial slots 38 formed therein.

As indicated previously, each intermediate member 12 and outer tube 20 resilient end portions 36 are made resilient by incorporation therein of circumferentially spaced, longitudinally extending axial slots 38 cut or otherwise formed therein. Slots 38 extend through the walls of tubes 12 and 20 and interrupt and segment projections 34 thereby forming the tine-like axial projections or prongs 40 thereon. Slots 38 extend axially, for a purpose to be later explained, a specified, predetermined distance from the inner end and function as vents for the escape of the gases generated by generator 18 from the interior of actuator 10 when in its extended position.

Referring now to FIG. 4, it will be appreciated that resilient ends 36 afford means for facilitating assembly of actuator 10 since tines or prongs 40 being cantilevered constructions permit radially inward bending thereof with relative ease under application of a compressive or squeezing force thereagainst thereby permitting end 36 to fit into and slide in the open end 42 of an adjacent tube 12, projection 34 passing over the recess 44 formed in the inner circumference of the surface of end 42. Each tube 12 is in successively fitted into an adjacent tube 12 including outer tube 20, the last to be assembled. The assembled telescoped together elements 12 and 20 are thereafter assembled in similar fashion, to base member 14.

OPERATION OF THE INVENTION

In operation, actuator 10 is extended by firing gas generator 18 by means of an electric squib or other well-known initiating means (not shown) to ignite a gas producing charge in generator 18 in base member 14 a suitable one, for example, being a charge composed of pellets of a boron-potassium-nitrate compound material matrixed in a binder of combustible rubber or plastic (also not shown). Gas thus produced pressurizes the interior of actuator 10 and hollow elements or tubes 12 and 20. The pressure of the gas causes elements 12 and 20 to move outwardly from the telescoped actuator position of FIG. 2 to the extended actuator position of FIG. 1 and unfolds collapsed nozzle extension 26 deploying it to the position shown in FIG. 1.

At the same time, when actuator 10 is extended by firing of gas generator 18, each annular projection 34 engages each recess 44 formed in the inner surface of outer end 42 of each corresponding tube 12, being seated therein under the urging of the resilient force supplied by inwardly bent cantilever tines or prongs 40, thereby automatically locking each member 12 and 20 into the extended position shown in FIG. 1. To facilitate relative movement of tubes 12, it is envisioned that these parts can have a slightly conical shape and such is desired as being within the scope of the invention.

Simultaneously with the seating of radial projections 34 in recesses 44 to lock members or elements 12 and 20 into extended position, the outer ends 46 of slots 38 function as escape ports for the gas generator 18 gases, slots 38 being sufficiently long to extend beyond the outer ends 42 of members 12 when the latter are extended to the position shown in FIG. 1, thereby uncovering escape ports or vents 46 and venting the gases produced by generator 18 overboard, as indicated by the arrows in FIG. 1.

In its preferred embodiment actuator 10 and tubular members, elements or tube segments 12 are made by winding or wrapping a tape or strip of graphite fibers on a graphite mandrel. In its preferred form the graphite is layed up in a helical pattern while impregnating the result with a high temperature, thermosetting resin, such as phenolic resin, and thereafter subjecting the impregnated product to a temperature of about 4000° F. to 5500° F. to graphitize the resin. Alternatively, the graphite wound or wrapped article can may be placed in an oven and heated at these high temperatures in the presence of, or in which a carbonaceous gas such as methane is circulated. The gas dissociates forming pyrolytic graphite, which in turn is deposited in the fibers of the winding or wrapping reducing porosity thereof.

Members or tubes 12, and for that matter base member 14 and outer tube 20, can also be made of a carbon/carbon composite made by pyrolyzing a carbon fiber/resin composite at temperatures which decompose the resin, followed by further re-impregnation and pyrolysis to yield a matrix of high char strength carbonaceous resin bonded to the carbon fiber. The carbon fiber/resin composite is formed as an array of wound carbon fibers or as an involute structure in the form of a woven carbon fiber fabric. Redensification may also be accomplished with a blend of coal tar pitch and furfural alcohol which, after infiltration is pyrolyzed to 4500° F. Alternatively also, the carbon/carbon composite may be placed in a high temperature oven through which a carbonaceous gas such as methane, above mentioned, is circulated. Pyrolytic graphite from dissociation of the gas will again be deposited in the interstices of the fiber matrix, reducing porosity and surface roughness thereof. The carbon/carbon composite is then machined by conventional methods to the geometry desired for the articles fabricated.

While a particular and preferred embodiment of the invention has been disclosed and described, it will be readily understood that other materials, for example, fiberglass tape, asbestos fiber cloth and metal fiber cloths of tungsten and the like can be used and methods employed which will occur to the skilled worker carrying out the invention.

What is claimed is:

1. A self-locking telescoping actuator having high temperature resistant properties operable in a high temperature environment for deploying a flexible body operating therein comprising:

a plurality of telescopically arranged tubular members having a telescoped position and an extended position including an inner member having a closed inner end and an opposite open end, an outer telescoping member having a closed outer end attached to said body and an opposite open end and at least one intermediate telescoping member open at both ends, said inner member adapted to be attached to a structure on which said body is to be deployed in fixed relation to said other members;

a gas generator in said fixed inner member providing a source of fluid pressure for extending said telescopically arranged members and thereby deploying said body;

said telescoping outer and intermediate members each having a resilient inner end for ease of telescoping said members into an adjacent member and an internal recess in an inner surface of an outer end portion of said inner and intermediate members;

an annular projection on each said resilient end for engaging said recess in member locking relation and being urged into said engagement by resilient force of said resilient end when said telescoping members are extended;

wherein said resilient end portion comprises means defining at least one axially extending slot in the open inner end of said outer member whereby radial bending of said end is facilitated and said projection is segmented; and means for venting said pressurizing fluid produced by said gas generator when said members are in said extended position;

wherein said vent means is provided by said axially extending slot.

* * * * *